US006345597B1

(12) United States Patent
Keeler

(10) Patent No.: US 6,345,597 B1
(45) Date of Patent: Feb. 12, 2002

(54) NON-ROTATABLE VALVE LIFTER MECHANISM

(76) Inventor: John D. Keeler, Rte. 330 [33190], Massey, MD (US) 21650

( * ) Notice: Subject to any disclaimer, the term of this patent is extended or adjusted under 35 U.S.C. 154(b) by 0 days.

(21) Appl. No.: 09/695,377

(22) Filed: Oct. 24, 2000

(51) Int. Cl.[7] ..... F01L 1/14

(52) U.S. Cl. ..... 123/90.5; 123/90.42; 123/90.16; 123/90.17

(58) Field of Search ..... 123/90.5, 90.15, 123/90.16, 90.17, 90.39, 90.42, 90.48, 90.6, 90.61

(56) References Cited

U.S. PATENT DOCUMENTS 3,795,229 A * 3/1974 Weber ..... 123/90.5
3,831,457 A * 8/1974 Kern ..... 123/90.5
3,886,808 A * 6/1975 Weber ..... 123/90.48
3,977,370 A * 8/1976 Humphreys ..... 123/90.5
5,188,067 A * 2/1993 Fontichiaro et al. ..... 123/90.5
5,231,960 A * 8/1993 White ..... 123/90.16
5,239,951 A * 8/1993 Rao et al. ..... 123/90.5
5,645,023 A * 7/1997 Regueiro ..... 123/90.5
5,673,661 A * 10/1997 Jesel ..... 123/90.48
5,678,514 A * 10/1997 Mazzella et al. ..... 123/90.5
5,809,956 A * 9/1998 Regueiro ..... 123/90.42
5,921,209 A * 7/1999 Regueiro ..... 123/90.5
6,213,075 B1 * 4/2001 Ajayi et al. ..... 123/90.42

* cited by examiner

*Primary Examiner*—Sang Paik
*Assistant Examiner*—Fadi H. Dahbour
(74) *Attorney, Agent, or Firm*—Connolly Bove Lodge & Hutz LLP

(57) ABSTRACT

A non-rotatable valve lifter mechanism for use in an internal combustion engine includes a rotatable cam shaft having at least one confinement member disposed on the cam shaft adjacent to its cam lobe. The valve lifter includes a follower and includes at least one abutment member in surface to surface contact with the confinement member to prevent rotation of the valve lifter. Preferably confinement and abutment members are on each side of the cam lobe and roller follower.

18 Claims, 2 Drawing Sheets

NON-ROTATABLE VALVE LIFTER MECHANISM

BACKGROUND OF THE INVENTION

Valve lifters in some internal combustion engines, especially high-speed automotive engines, use rollers that ride in contact with the cams of cam shafts that operate the lifters. As the cam shaft rotates the cams reciprocate the lifters which are cylindrical and move in cylindrical bores of the engine block. It is necessary to prevent the valve lifters from rotating in the bores in order to keep the rollers properly aligned with the cams. Lifters are typically aligned in a row along the cam shaft with a cam being provided for each of the lifters.

Various means have been suggested to prevent rotation of the valve lifters. U.S. Pat. Nos. 5,022,356 and 4,173,954, for example, utilize bridging members which interconnect adjacent lifters so that the lifters can not rotate and thus the rollers would be maintained in their proper position for contact by the cams.

SUMMARY OF THE INVENTION

An object of this invention is to provide an arrangement for preventing rotation of valve lifters which does not require any interconnection between adjacent lifters.

A further object of this invention is to provide such an arrangement or mechanism that is effective in operation.

A still further object of this invention is to provide such an arrangement or mechanism wherein each valve lifter would have its own structure independent of other valve lifters for preventing rotation.

In accordance with this invention each cam lobe on the cam shaft would be provided with a confinement member located on one side of the cam lobe. The valve lifter would have an abutment member located at its roller follower in such a position to be disposed against and in contact with the confinement member. Thus, as the cam lobe rotates the confinement member rotates with the cam lobe but maintains surface to surface contact with the abutment member. This surface to surface contact prevents rotation of the valve lifter.

In a preferred practice of this invention a confinement member is provided on each side of each cam lobe and a corresponding abutment member is disposed on each side of the roller follower of the cam lifter. The confinement member is of non-circular cross-section and preferably has an outer surface that complements the outer surface of the contacting portion of the abutment member to maintain surface to surface contact without any significant degree of rotation. These contacting surfaces or edges may be tapered or beveled surfaces. Each confinement member may also have a second beveled edge in surface to surface contact with a beveled edge of the roller.

THE DRAWINGS

DETAILED DESCRIPTION

Figure 1:
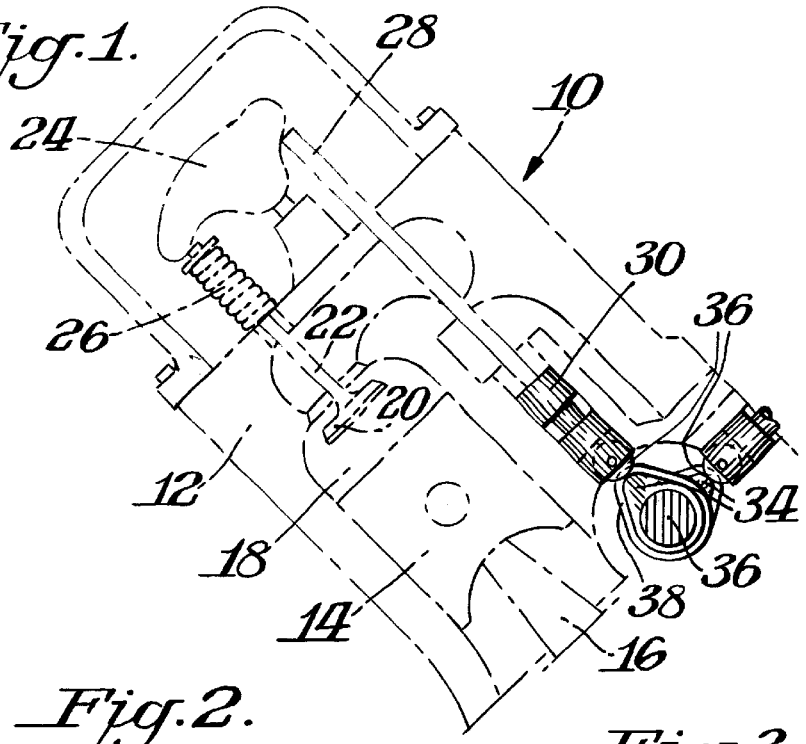
FIG. 1 is a fragmental cross-sectional view of a portion of an internal combustion engine showing one cylinder with its valve lifter and cam shaft.

FIG. 1 illustrates a typical internal combustion engine 10 which is shown in phantom. As shown therein, the engine block 12 includes a piston 14 mounted at the end of a piston rod 16 in a combustion chamber 18. A valve 20 at the end of a valve stem 22 is disposed against a rocker arm 24. A spring 26 is mounted around the valve stem 22. A push rod 28 is disposed against the opposite side of the rocker arm 24. Push rod 28 is mounted to valve lifter 30. In actual practice a plurality of valves and valve lifters is provided in series, although the invention could be practiced with only a single valve lifter. A cam shaft 32 is provided having a cam lobe 34 provided for each of the valve lifters. The outer peripheral surface of the lobe 34 is in contact with a follower 36 in the form of a roller mounted on shaft 48 secured to the valve lifter. Thus, as the cam shaft rotates the lobe 34 is maintained in contact with roller follower 36 to reciprocate the valve lifter 30 in an up and down direction thereby controlling the actuation of the valve 20 in a known manner.

The present invention relates to structure for assuring proper contact of the roller 36 with the cam lobe 34 by preventing rotation of the valve lifter and by preventing any sliding misalignment.

Figure 2:
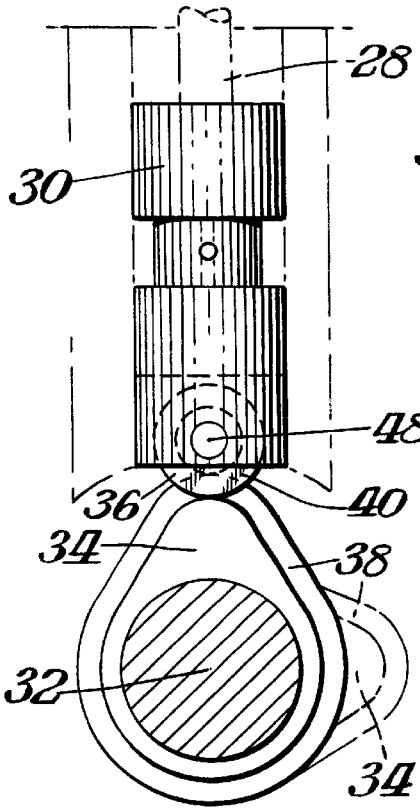
FIG. 2 is a front elevational view of the valve lifter and cam shaft shown in FIG. 1.
Figure 3:
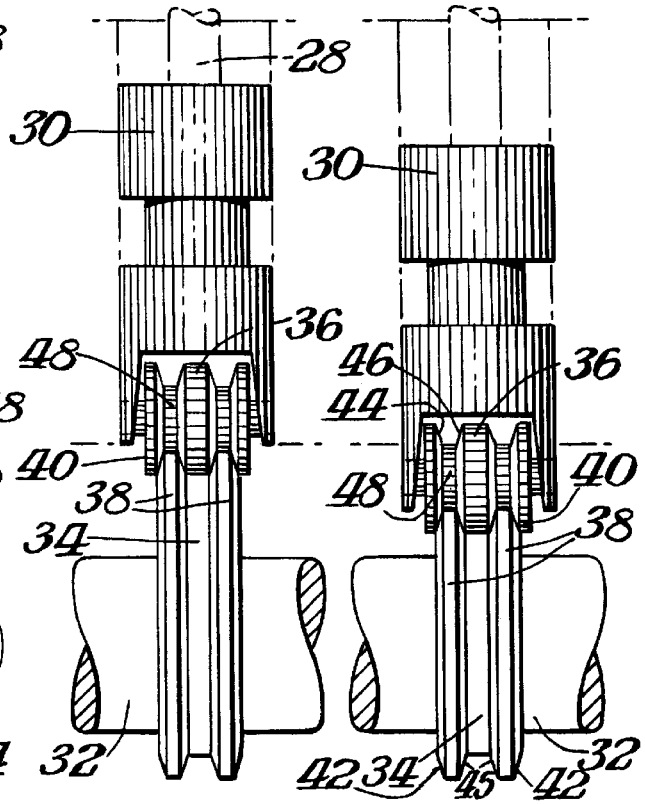
FIG. 3 is a side elevational view of the valve lifter and cam shaft shown in FIG. 2 in both the open and closed positions of the valve.
Figure 4:
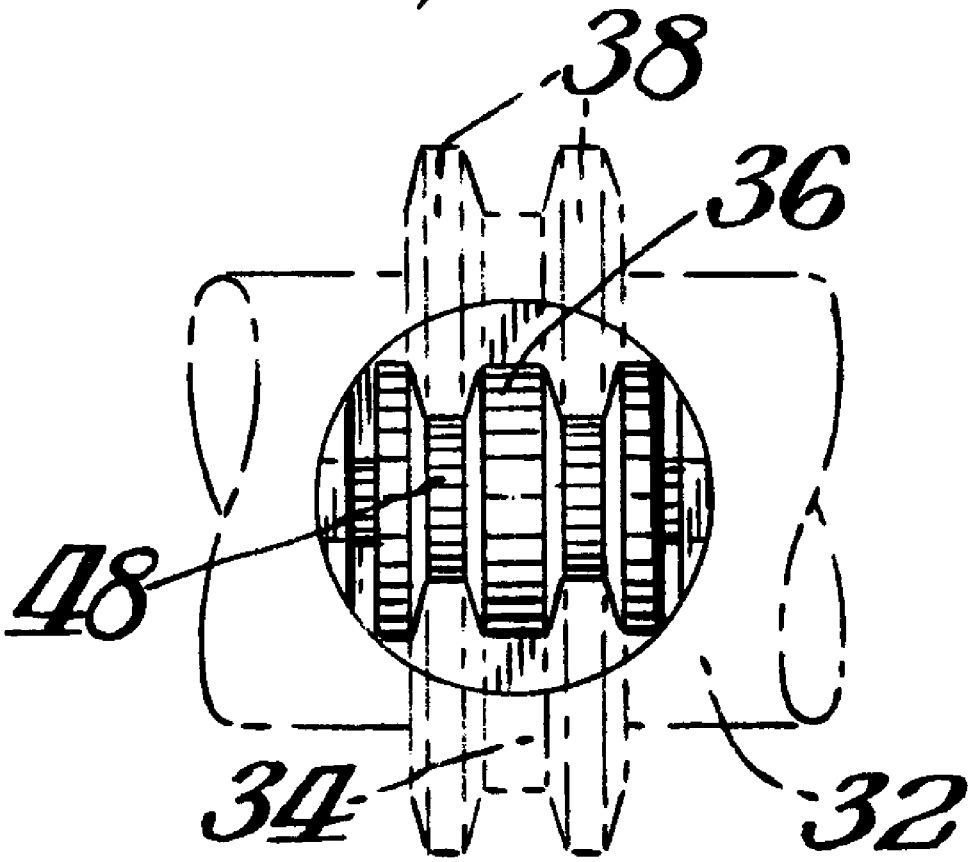
FIG. 4 is a bottom plan view of the valve lifter and cam shaft shown in FIGS. 2–3.

As shown in FIGS. 2–4 rotation of the valve lifter 30 is prevented by providing a confinement member 38 on each side of the cam lobe 34. Confinement member 38 is generally of the same shape as lobe 34, but extends peripherally outwardly a greater distance from cam shaft 32. Confinement members 38,38 can be integral with lobe 34 or can be separate members juxtaposed against or even spaced from lobe 34.

As also illustrated in FIGS. 2–4 roller 36 is provided with a complementary abutment member 40 for each confinement member 38. Each abutment member 40 is spaced from roller follower 36 by a distance sufficient to accommodate the confinement member 38 being disposed in the space between its respective rotation resistance member 40 and roller 36. In the preferred practice of this invention confinement member 38 has a surface 42 which is in contact with a complementary surface 44 of abutment member 40 and preferably also has a second surface 45 which is in contact with a complementary shaped surface 46 on roller follower 36. Such complementary surfaces are preferably formed by tapering or beveling the outer edge 42 of each confinement member 38 at the same angle as a taper 44 on abutment member 40 and tapering the opposite edge 45 with the same taper 46 on roller follower 36.

As a result of the contact, which preferably is a surface to surface contact between the confinement member 38 and the abutment member 40 and preferably also between the confinement member 38 and the roller follower 36, contact is maintained between the guide member 38 and the structure on valve lifter 30, namely the corresponding abutment member 40 and the roller 36. This contact is maintained throughout the rotation of cam shaft 30 and the consequent rotation of cam lobe 34 and confinement members 38. FIG. 3, for example, shows the valve in the open position with the valve lifter raised upwardly in the lefthand portion of that figure and shows the valve in the closed position with the valve lifter in a down orientation and also shows that the contact is maintained between corresponding portions of the confinement members 38 and their associated abutment members 40, as well as roller follower 36.

In addition to preventing rotation of the valve lifter 30 the present invention also assures that the cam lobe 34 is maintained in contact with the roller follower 36 by confining the cam lobe 34 in its contacting position since sideward movement is also prevented due to the confinement members 38 being interposed between the abutment members 40 and the cam roller 36.

In conventional internal combustion engines there would be a plurality of valve lifters and cam lobes generally arranged in pairs with each cam lobe being associated with a valve lifter. The invention, however, may also be practiced where the internal combustion engine includes only a single cam lobe and single valve lifter.

The invention may be practiced in its broad sense by providing some form of extension from the cam shaft or roller shaft which is maintained in constant contact with a corresponding surface on the other of the cam shaft or roller shaft.

Where a confinement member and an abutment member are used, it is not necessary that the confinement member be of the same general shape of the cam lobe provided that the confinement member be maintained in contact with the abutment member during rotational movement of the cam shaft. It is preferable that the contact be a surface contact, although the invention may also be practiced with a line contact.

The invention may be practiced where the abutment member makes contact on at least a part of its surface with at least a part of the surface of the cam lobe, in which case the side surface of the cam lobe would function as the confinement member.

The invention could be practiced with only a single confinement member and a single abutment member for each valve lifter. The preferred practice, however, is to provide a confinement member on each side of the cam lobe and a corresponding abutment member on each side of the roller follower.

The drawings, however, illustrate the preferred practice of the invention wherein a confinement member is mounted on each side of and preferably against (including being integral with) the cam lobe and wherein a separate abutment member is provided on each side of and spaced from the roller follower with the spacing being such that a tapered surface 42,45 on each peripheral edge of the confinement member 38 is in surface contact with a corresponding taper 44,46 on the abutment member and on the side of the roller follower 36.

A further characteristic of the confinement member is that during its rotation on the cam shaft it should maintain contact with some surface on the rotating portion of the valve lifter. In its broad aspect the confinement member could be of circular shape provided such contact is maintained. In the preferred practice of the invention, however, the confinement member is of non-circular shape and is preferably of a shape generally the same as the shape of the cam lobe.

It is to be understood that the invention in one aspect may be practiced where a confinement member 38 is on each side of the roller follower 36 and contacts a respective side of the roller follower. In such practice the contacting side of the roller follower may be considered as the abutment member. This simplified version would still prevent rotation by utilizing the projection guides to confine roller follower while also functioning to limit any sideward movement. The provision, however, of separate abutment members spaced from the roller follower provides even greater assurance of rotation prevention and minimization of lateral movement.

Conversely, the sides of the cam lobe could function as the confinement members by being maintained in rotational contact with abutment members on the roller shaft.

The invention thus provides various techniques for preventing rotation of the valve lifter and for preventing any sideways misalignment between the valve lifter and its respective cam lobe on the cam shaft.

What is claimed is:

1. A non-rotatable valve lifter mechanism for actuating at least one intake and exhaust valve in an internal combustion engine, comprising, in combination, a rotatable cam shaft, at least one cam lobe extending outwardly peripherally around said cam shaft, said cam lobe having a peripheral outer surface, a confinement member on said cam shaft located on one side of said cam lobe extending outwardly from said cam shaft, a valve lifter disposed at said cam lobe, said valve lifter having a follower for riding against said peripheral outer surface of said cam lobe to move said valve lifter toward and away from said cam shaft in accordance with the rotational position of said cam lobe, and said valve lifter having an abutment member disposed in moving contact with said confinement member to prevent rotation of said valve lifter during reciprocal movement of said valve lifter toward and away from said cam shaft.

2. The mechanism of claim 1 wherein said follower is a roller rotatably mounted on a valve lifter shaft.

3. The mechanism of claim 2 wherein said confinement member is of non-circular shape.

4. The mechanism of claim 3 wherein said confinement member makes surface to surface contact with said abutment member during rotational movement.

5. The mechanism of claim 4 wherein said confinement member is generally of same shape as said cam lobe but extends peripherally beyond said cam lobe.

6. The mechanism of claim 5 wherein said abutment member has a tapered surface, and said confinement member has a complementary tapered surface in surface to surface contact with said tapered surface of said abutment member.

7. The mechanism of claim 6 wherein said follower has a tapered surface, and said confinement member having a second tapered surface in surface to surface contact with said tapered surface of said follower.

8. The mechanism of claim 7 wherein there are a series of said cam lifters and a corresponding number of said cam lobes on said cam shaft.

9. The mechanism of claim 8 in combination with an internal combustion engine.

10. The mechanism of claim 1 wherein said confinement member is of non-circular shape.

11. The mechanism of claim 1 wherein said confinement member makes surface to surface contact with said abutment member during rotational movement.

12. The mechanism of claim 1 wherein said confinement member is generally of same shape as said cam lobe but extends peripherally beyond said cam lobe.

13. The mechanism of claim 1 wherein said abutment member has a tapered surface, and said confinement member has a complementary tapered surface in surface to surface contact with said tapered surface of said abutment member.

14. The mechanism of claim 1 wherein said follower has a tapered surface, and said projection guide having a second tapered surface in surface to surface contact with said tapered surface of said follower.

15. The mechanism of claim 14 wherein there are a series of said cam lifters and a corresponding number of said cam lobes on said cam shaft.

16. The mechanism of claim 1 in combination with an internal combustion engine.

17. The mechanism of claim 1 wherein said follower has a pair of opposite sides, each of said opposite sides having a contact surface, one of said confinement member being in surface to surface contact with a contact surface of said follower, and each of said contact surfaces of said follower being a respective one of said abutment members.

18. The mechanism of claim 1 wherein said confinement member makes surface to surface contact with said abutment member during rotational movement.

* * * * *